United States Patent [19]

Neumann et al.

[11] 4,078,501

[45] Mar. 14, 1978

[54] PEDESTAL ROOF WEAR LINER

[75] Inventors: Otto Walter Neumann, Chicago; Frank Joseph Korpics, Streamwood, both of Ill.

[73] Assignee: Amsted Industries Incorporated, Chicago, Ill.

[21] Appl. No.: 770,819

[22] Filed: Feb. 22, 1977

Related U.S. Application Data

[62] Division of Ser. No. 601,347, Aug. 4, 1975, Pat. No. 4,034,681.

[51] Int. Cl.[2] ..... B61F 5/32; B61F 15/20

[52] U.S. Cl. ..... 105/225; 105/218 R

[58] Field of Search ..... 105/218 R, 218 A, 219–221, 105/222, 223, 224 R, 224 A, 224.1, 225; 308/63, 64, 180

[56] References Cited

U.S. PATENT DOCUMENTS

| | | | |
|---|---|---|---|
| 1,146,493 | 7/1915 | Gilman | 105/218 R X |
| 1,476,463 | 12/1923 | Posson | 105/225 |
| 1,708,993 | 4/1929 | Woodman | 105/225 |
| 2,301,726 | 11/1942 | Kirsten et al. | 105/222 |
| 2,326,426 | 8/1943 | Baker | 105/225 |
| 3,276,395 | 10/1966 | Heintzel | 105/225 X |
| 3,897,736 | 8/1975 | Tack | 105/225 |

*Primary Examiner*—Drayton E. Hoffman
*Assistant Examiner*—Fred A. Silverberg
*Attorney, Agent, or Firm*—Fred P. Kostka

[57] ABSTRACT

A wear liner is provided for the roof of the pedestal jaw of a side frame. The liner is welded in place only along the lateral edges of the liner and is retained in place, in the event of weld failure, by depending legs engageable with pedestal jaw stop lugs. Additional retaining lugs may be provided in the pedestal jaw roof.

3 Claims, 4 Drawing Figures

PEDESTAL ROOF WEAR LINER

This is a division of application Ser. No. 601,347, filed Aug. 4, 1975 now U.S. Pat. No. 4,034,681.

This invention relates generally to trucks for railway vehicles and particularly to wear liners for the roof of the pedestal jaws of a railway car truck side frame.

It has been customary to provide a wear liner between the bearing adapter and the roof of the pedestal jaw in which a roller bearing assembly is received. The purpose of the wear liner is to prevent wear in the pedestal roof caused by oscillating motions of the side frame relative to the wheel and axle assembly. Such wear liners are plug welded to the roof through two, three or four holes formed in the liner. It has been found that these welds, because they are located in and interrupt the wear surface of the liner, tend to crack and fail, particularly in heavy duty, high speed service. In such service, there tends to be intermittent vertical separation of the liner and the roller bearing adapter so that, upon weld failure, the liner is subject to lateral displacement and possible loss. Even if the liner is not lost because of the weld failure, there will still occur an undesirable amount of relative movement between the liner and the pedestal roof. This causes wear in the roof which the liner is supposed to eliminate.

It is an object of the present invention to provide a pedestal roof wear liner that is retained mechanically in the event of weld failure.

A further object of the invention is to provide a wear liner which is welded to the pedestal roof in areas away from the liner wear surface.

Another object of the invention is the provision of retaining lugs in the pedestal roof to restrain lateral movement of the wear liner in the event of weld failure.

These and other objects will be apparent from the following description and accompanying drawings wherein.

Figure 1:
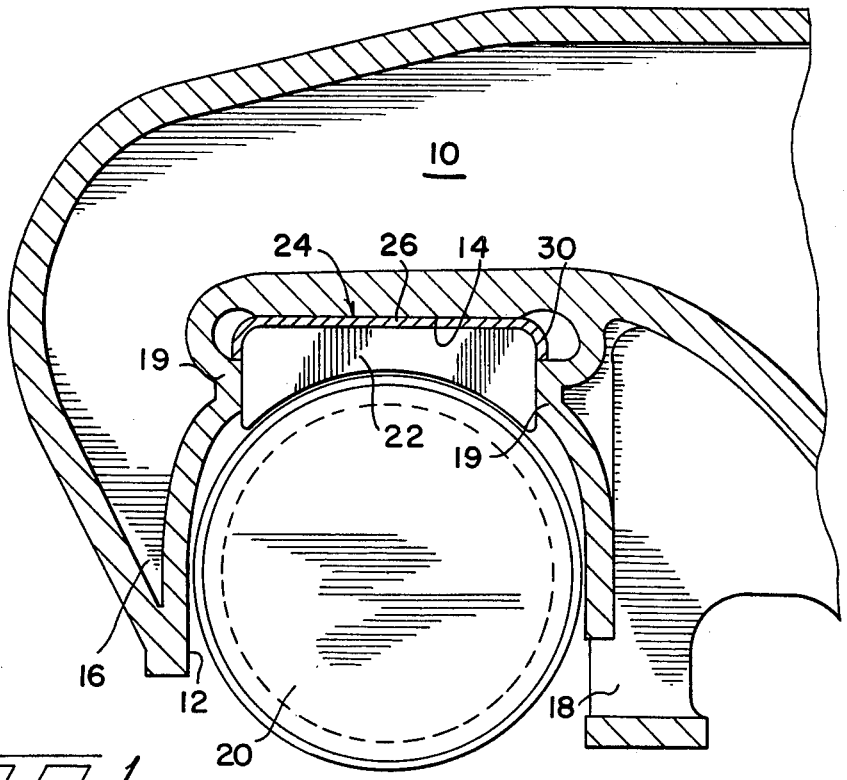
FIG. 1 is a partial front sectional view of one end of a pedestal type side frame including one embodiment of the present invention.
Figure 2:
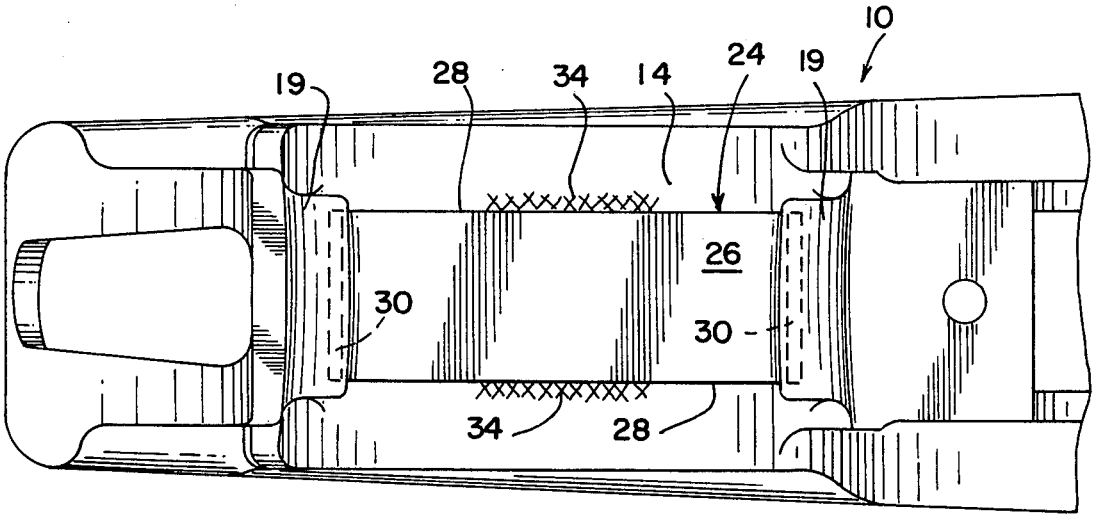
FIG. 2 is a bottom view of the structure of FIG. 1 with certain parts removed for clarity.

Referring now to the drawings, and particularly to FIGS. 1 and 2, a pedestal type side frame is indicated generally at 10 and includes a downwardly open jaw 12 defined by a pedestal roof 14 and depending legs 16 and 18. It should be understood that a side frame is symmetrical longitudinally and each end thereof includes a pedestal jaw. The pedestal jaw 12 is arranged to receive a conventional roller bearing assembly 20 and a bearing adapter 22 which is restrained from lateral movement by a pair of opposed stop lugs 19.

Positioned between the bearing adapter 22 and the pedestal roof 14 is a wear liner indicated generally at 24. The wear liner includes a body portion 26 having opposed lateral edges 28 extending longitudinally of the side frame 10, and depending legs 30. In the embodiment of FIGS. 1 and 2 the depending legs extend downwardly toward and terminate closely adjacent to the stop lugs 19.

The body portion 26 is welded as shown at 34 for at least a portion of the length of the lateral edges 28. It should be noted that this weldment requires substantially less welding material and requires less welding time than the prior art plug welds. Furthermore, it has been found that weldments located along the lateral edges 28, being completely away from the wear surface of the liner 24, are less subject to failure. However, even in the event of weld cracking, the wear liner will be restrained from undesirable extraneous movement by the engagement of the stop lugs 19 by depending legs 30, thereby minimizing wear in the pedestal roof.

Figure 3:
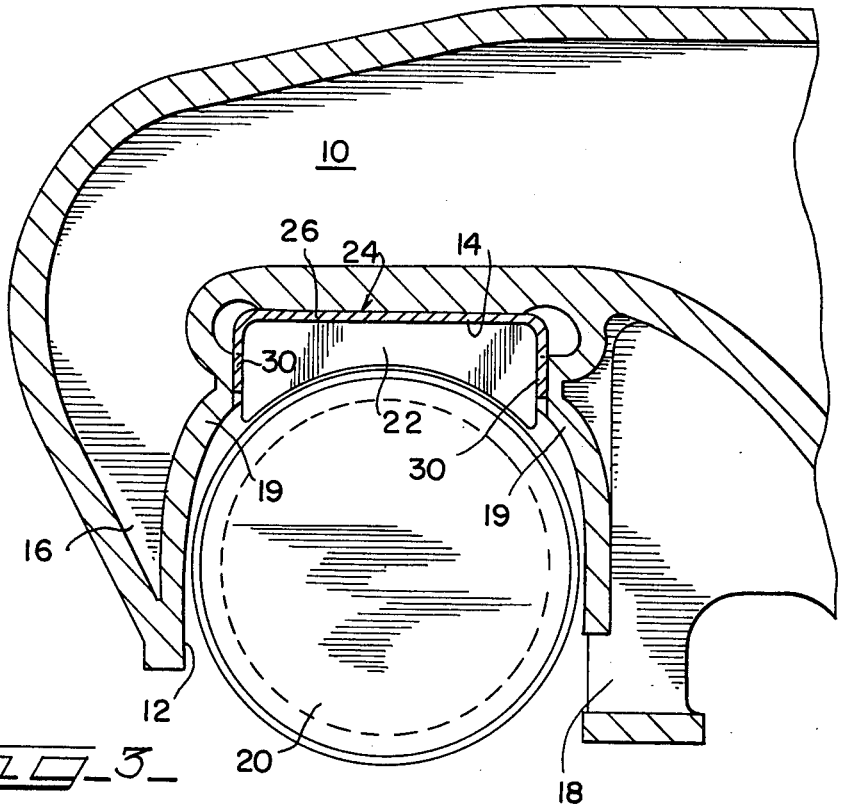
FIG. 3 is a partial sectional view similar to FIG. 1, showing another embodiment of the invention.
Figure 4:
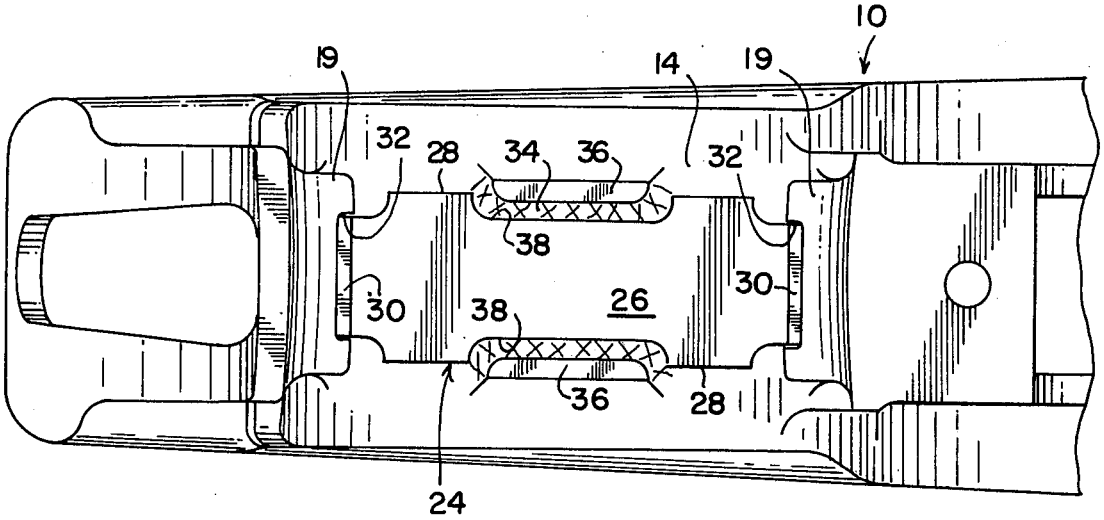
FIG. 4 is a bottom view of the structure of FIG. 3 with certain parts removed for clarity.

FIGS. 3 and 4 show another embodiment wherein mutually facing recesses 32 are formed in the opposed stop lugs 19 and the depending legs 30 extend downwardly far enough to be received in these recesses. This arrangement provides even greater restraint, in the event of weld failure, for the wear liner than does the earlier described embodiment.

If desired, either of the previously described wear liners may be provided with recesses 38 in the lateral edges 28 as shown in FIG. 4. These recesses are arranged to receive, in slightly spaced relationship, retaining lugs 36 preferably cast integrally with the pedestal roof and in substantial alignment with the lateral edges 28. In this construction, the wear liner is welded to the pedestal roof in the space between the wall of each recess and the corresponding retaining lug as seen in FIG. 4.

Thus it is seen that an improved wear liner arrangement for a pedestal type side frame has been provided which will greatly diminish the possibility of failure of the weldment securing the liner to the pedestal roof. The arrangement will also provide lateral retention of the wear liner in the event of weld failure thereby restraining the wear liner from the undesirable movement which can result in the loss of the liner or, at the very least, cause undue wear in the pedestal roof.

I claim:

1. In a pedestal type side frame with a downwardly open jaw which includes a roof and depending legs with opposed stop lugs, a bearing assembly received in the jaw, a bearing adapter overlying the bearing assembly, and a wear liner disposed between the roof and the adapter, the improvement wherein the wear liner includes a body portion having lateral edges extending longitudinally of the side frame, said body portion being welded to the roof along at least a portion of said edges, said wear liner including depending legs engageable with and retained in position by said stop lugs in the event of weld failure, and wherein said opposed stop lugs are provided with mutually facing recesses, and the depending legs of said wear liner are received in the stop lug recesses.

2. In a pedestal type side frame with a downwardly open jaw which includes a roof and depending legs with opposed stop lugs, a bearing assembly received in the jaw, a bearing adapter overlying the bearing assembly, and a wear liner disposed between the roof and the adapter, the improvement wherein the wear liner includes a body portion having lateral edges extending longitudinally of the side frame, said body portion being welded to the roof along at least a portion of said edges, said wear liner including depending legs engageable with and retained in position by said stop lugs in the event of weld failure, and wherein recesses are provided in said lateral edges, retaining lugs are provided in said roof parallel to and spaced from said recesses, and the weld holding the wear liner body to the roof is disposed in said edge recesses.

3. A pedestal type side frame with a downwardly open jaw which includes a roof and depending pedestal legs with opposed stop lugs, a bearing assembly received in the jaw, a bearing adapter overlying the bearing assembly, and a wear liner disposed between the roof and the adapter, the improvement wherein spaced retaining lugs project downwardly from the roof and extend longitudinally of the side frame; the wear liner comprises a flat body portion having lateral edges extending longitudinally of the side frame and aligned with said retaining lugs, said edges being recessed to receive the retaining lugs, the body portion being welded, at said recesses, to the roof and the retaining lugs; and legs on said wear liner depending downwardly from said body portion and aligned with said stop lugs, said wear liner being engageable with and retained in place by said stop lugs and retaining lugs in the event of weld failure.

* * * * *